US005833226A

United States Patent [19]

Claassen

[11] Patent Number: 5,833,226

[45] Date of Patent: Nov. 10, 1998

[54] IN-LINE DESERTER AND INTEGRATOR APPARATUS AND METHOD

[75] Inventor: Robert Claassen, Medford, Oreg.

[73] Assignee: Masterflo Technology, Ltd., Brossard, Canada

[21] Appl. No.: 740,244

[22] Filed: Oct. 25, 1996

[51] Int. Cl.[6] ..... B65H 39/00

[52] U.S. Cl. ..... 270/52.16; 270/58.33

[58] Field of Search ..... 270/52.01, 52.14, 270/52.16, 58.01, 58.3, 58.33

[56] References Cited

U.S. PATENT DOCUMENTS

| | | | |
|---|---|---|---|
| 4,330,116 | 5/1982 | Newsome | 271/178 |
| 4,482,142 | 11/1984 | McCain et al. | 270/54 |
| 4,522,384 | 6/1985 | Beckley | 270/54 |
| 4,747,817 | 5/1988 | Newsome | 270/52.14 X |
| 5,499,803 | 3/1996 | Farr | 270/52.14 |

*Primary Examiner*—Hoang Nguyen

*Attorney, Agent, or Firm*—Chernoff, Vilhauer, McClung & Stenzel

[57] ABSTRACT

An in-line deserter and integrator for separating books of nested folded product and reintegrating them into a single stream on a conveyor includes a separator section of conveyor belts for lengthening the pitch of the shingled stream, a speed differential section having belts and associated pinch rollers operating at different speeds to pull one part of the nested folded product forwardly of the other, a high-speed deshingling belt section completely separating the product and a reintegrator section for restacking the separated product into a single shingled stream.

14 Claims, 4 Drawing Sheets

IN-LINE DESERTER AND INTEGRATOR APPARATUS AND METHOD

BACKGROUND OF THE INVENTION

The following invention relates to a machine for separating two nested identical folded products available in a shingled array such that they may be delivered in a single shingled non-nested array and for joining two separate shingled non-nested streams into a single shingled non-nested array.

In the printing industry, rotary printing presses commonly have one or two folding devices at their discharge end where the printed products are folded and ejected in a shingled stream array and carried away for further finishing operations by a continuous conveyor system, one per folding machine. When a printed product comprises one or more sheets folded together at a folding machine, this printed product is called a "book." As an example, one section of a newspaper is a grouping of many sheets folded once in a half fold, and this is referred to as a book. Where the book is folded is known as the backbone. The second section of the same newspaper is a different book nested in the outer book and the third section may be nested in the second book. A folding machine typically delivers one book at a time and lays each down with the backbone side oriented forwardly in a shingled stream. A shingled stream is an arrangement of books in which a second book rests on top of a first book on a conveyor system such that the backbone side of the first book is slightly forward of the second book's backbone. Each succeeding book is arranged in the same way. This shingled stream delivery pattern is a standard within the printing industry upon which a host of product finishing equipment exists to complete the printing production process in an automated fashion.

More often than not, a printing establishment is faced with the production need to use a rotary press to print a specific product while using half, or less, of the full width of the rotary press. This is an inefficient usage of expensive rotary presses. In addition, the cost of the production run is increased by the additional requirement of cleaning up the non-utilized portion of the press. It is therefore desirable to use the full width of a press which often necessitates that two, or more, printing jobs are run simultaneously. Each stream of books thus printed requires a dedicated folding machining and finishing equipment. After printing, a single folding machine may be configured to process two, or more, books simultaneously. When a folding machine is configured to run two books simultaneously, the side by side books are ejected from the folding machine in the same shingled array. However the two side-by-side books are delivered such that one of these books is nested within the other. For purposes of dealing with this nested book shingled array, the nested book, the inner one, is automatically placed in the outer book so that one side edge protrudes beyond the side edge of the outer book by one or two inches. This array is called a shingled nested stream. When the outer book is a different product than the inner book, the inner book must be separated or stripped from the outer book thus creating two, or more, separate shingled non-nested streams for the individual final trimming, stacking and other post production operations.

This separation, called stream desertion, is currently handled by machines commonly known as "stream deserters" and such a device is shown in Fisher, et al. U.S. Pat. No. 4,477,066. Another example of such a device is shown in co-pending patent application, Ser. No. 08/334,267 filed Nov. 3, 1994 and entitled "Modular Folded Sheet Conveyor System" which is assigned to the same assignee as the application of the present invention. With the aforementioned stream desertion devices, the separation of the inner book from the outer book is performed by pulling one of the books away from the other by causing one of the two books to move at an angle to the forward motion of the other while the other continues along a conveyor belt. These devices create two independent product shingled streams, each requiring its own set of finishing equipment.

While the creation of two streams is necessary when the inner nested book and the outer book are different products, it would be desirable to separate them and join them into one single non-nested shingled stream when the two books are the same product so that only one set of the finishing equipment, staff and attendant floor space would be required.

As previously mentioned, some rotary printing presses are equipped with two, or more, folding machines such as the Rockwell C-700 press. Where multiple folders operate, each folding machine ejects to a dedicated set of finishing equipment. When such multiple folders of a press deliver the same product in shingled non-nested arrays, it would be desirable to have a means to integrate these streams into one singled shingled stream.

What is needed, therefore, is a method and apparatus that provides a means to desert a single nested stream into one, or two, shingled non-nested streams or to join two shingled non-nested streams into a single non-nested stream and to accomplish these objectives with a minimum amount of equipment re-alignment between different printing run configurations. By the use of such a method and apparatus, many arrangements could be used to maximize the production capacity of a printing establishment.

SUMMARY OF THE INVENTION

The method and apparatus of the invention provides an in-line deserter and integrator that separates books of nested folded product and reforms them into a single shingled stream which may then be processed by a single set of finishing apparatus such as conveyors, trimmers, stackers and counters. Each of the books of nested folded product has a leading folded edge termed a "backbone." When the books are conveyed in a shingled stream, i.e., are overlapped, the distance between the backbone of one book and the next is called the pitch of the shingled stream. Usually a shingled stream is conveyed by an endless belt-type of conveyor mechanism. The method of the present invention is primarily applicable to a shingled stream being conveyed at a base speed along an endless belt conveyor.

The method for deserting books of nested folded product includes the steps of lengthening the pitch of the shingled stream, denesting each book by moving one portion of each of the books ahead of the other nested portion while both portions are being conveyed in a linearly forward direction, accelerating the semi-nested portions to completely free the portions from one another and integrating the respective denested portions into a single shingled stream of product.

The pitch of the shingled stream is lengthened by conveying the stream from an endless belt infeed conveyor running at a base speed to a pitch enhancing separator endless belt section running at a speed in excess of the base speed. The faster pitch enhancer conveyor section pulls the books of product forwardly of each other one at a time, but in doing so increases the pitch of the stream. This occurs because of the acceleration of each book, one at a time, caused by the increased belt speed as the shingled books transition from the infeed conveyor to the higher speed separator conveyor section.

Once the pitch has been lengthened, the shingled stream may be fed to a speed differential section which includes two independent endless belt and pinch roller sections, one on each side of the shingled stream. The purpose of this section is to advance the outer book in relation to the inner book of each set. A first belt and pinch roller engages an edge of the outer portion of the nested folded product, and the other pinch roller and belt engages the edge of the inner portion of the folded product. There is a speed differential of about 20% between the two belts and rollers so that the first belt and its associated pinch roller operate at a faster speed than the other belt and pinch roller. The effect of the speed differential is to pull the outer book forwardly of the inner book. This effects a partial separation or de-nesting of the nested folded product so that the outer portions become staggered with respect to the inner nested portions.

At the output of the speed differential conveyor section there is a deshingling conveyor section which operates at a higher speed than either of the two belt speeds of the speed differential section. This section completely separates the outer book from the inner book by an instantaneous spaced transition that operates in a manner similar to the pitch enhancer section. The transition between the speed differential section and the deshingling section accelerates each portion of the previously nested folded product to pull it completely free of the other portion.

Once this occurs the stream enters a reintegrator section having belts that engage the top of each book and the books are fed downwardly so that each lagging book portion lands on top of each leading book portion in a shingled relationship. The pitch of the shingled stream is governed by the speed of an outfeed conveyor which is typically running at a speed that is on the order of the base speed of the infeed conveyor.

In addition to the pinch rollers of the speed differential section, the separator conveyor section, the deshingling conveyor section and the integrator conveyor section may both have associated pinch rollers to keep the product from scattering during high-speed conveyor belt operations. Typically these pinch rollers are passive devices.

In order to provide the maximum degree of control, separate variable speed motors may be used for each endless belt conveyor section that requires a different speed. Preferably the separator conveyor section has a belt speed which is approximately four times the base speed of the infeed conveyor. The speed differential section includes a belt section having the same speed as the separator conveyor section and a second belt section on the other side of the shingled stream having a speed which is approximately twenty percent faster. The endless belt conveyor of the deshingling section typically should have a speed which is about ten times as fast as the base speed, as do the integrator top feed belts. The outfeed conveyor has a speed that is comparable, but not necessarily equal to, the base speed.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
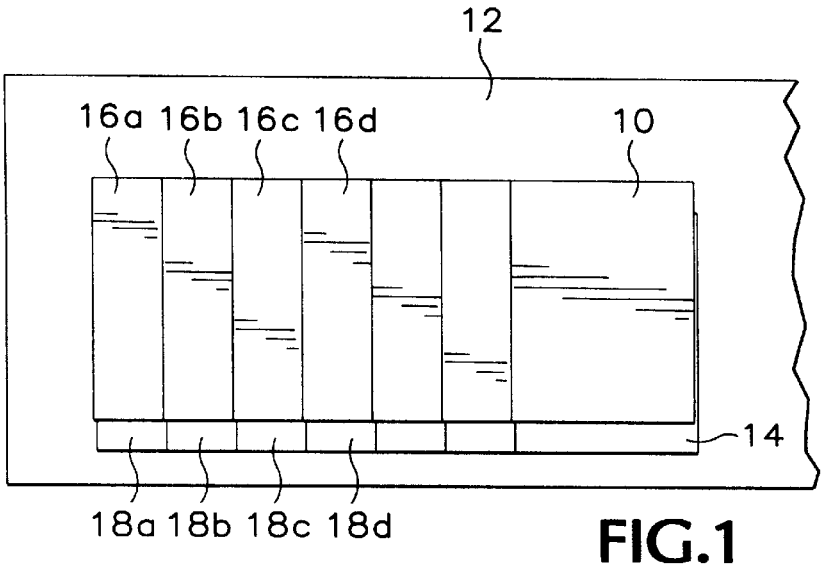
FIG. 1 is a plan view schematic drawing of a shingled stream of nested folded product on an endless belt conveyor.
Figure 1A:
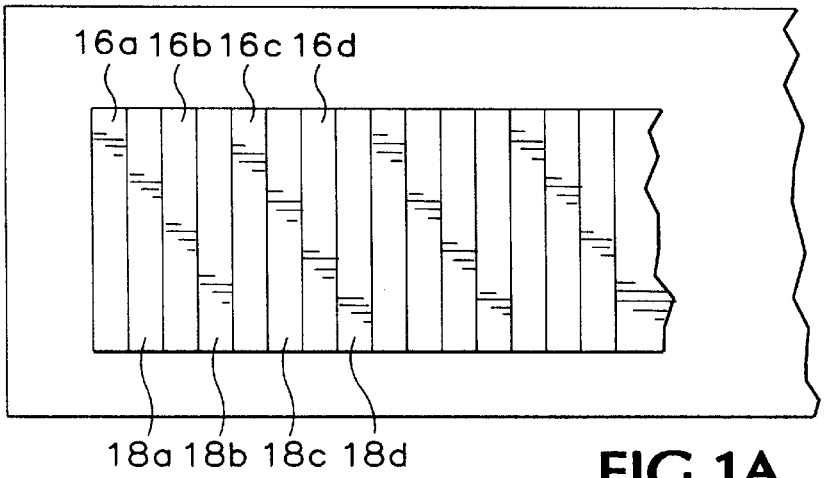
FIG. 1A is a plan view schematic drawing of a shingled stream of non-nested folded product.
Figure 1B:
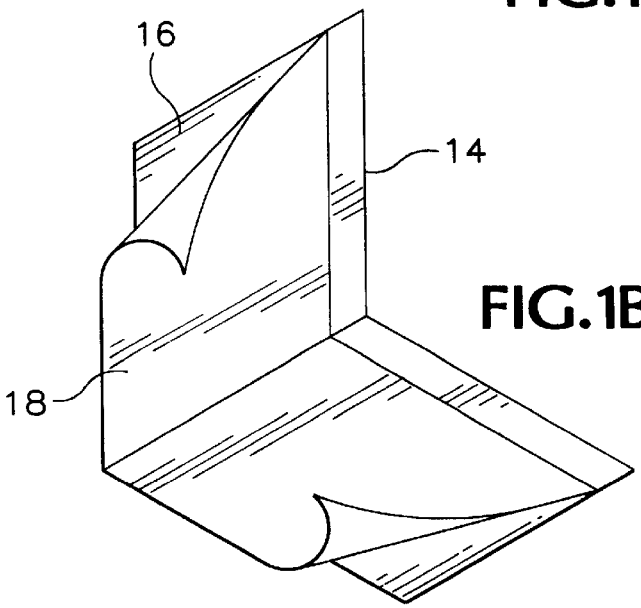
FIG. 1B is a perspective view of a nested book of the type illustrated in FIG. 1.

Referring to FIGS. 1, 1A and 1B, a shingled stream of nested folded product 10 is transported along a conveyor 12 of the endless belt variety. The shingled stream of product 10 comprises books 14 of nested folded product. Each of the books 14 includes an outer portion 16 and an inner nested portion 18. (Refer to FIG. 1B.) The shingled stream of product 10 has a pitch as shown by the arrow in FIG. 1. The pitch is defined as the distance between the backbone of one book and the backbone of the next book.

Figure 2:
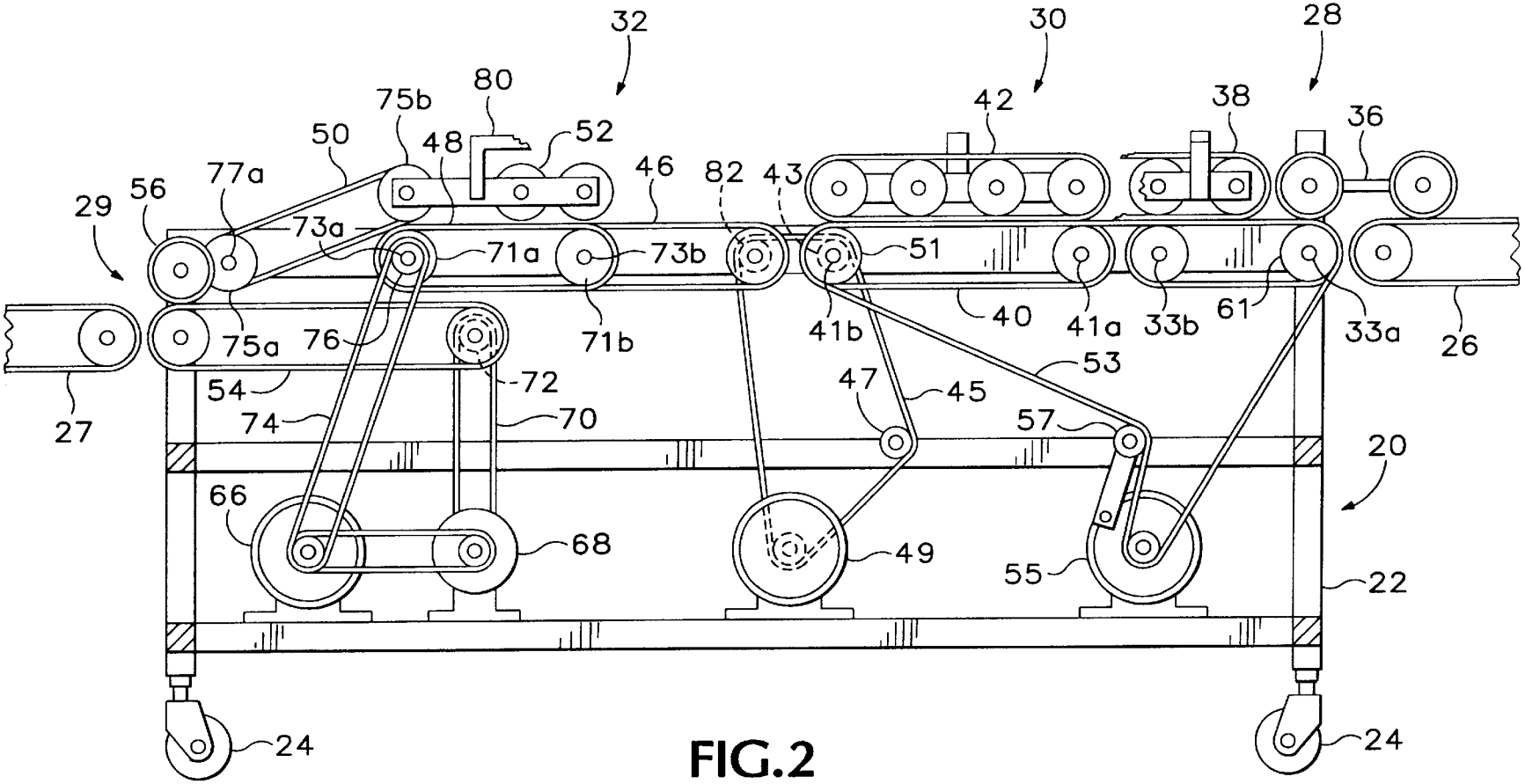
FIG. 2 is a side elevation view of the in-line deserter/integrator of the present invention.

Referring to FIG. 2, an in-line deserter 20 includes a frame 22 which may be supported on casters or wheels 24 and may thus be moved from place to place as dictated by the needs of the processing facility. A shingled stream of product is fed to the in-line deserter 20 along an infeed conveyor 26, and is deposited onto an outfeed conveyor 27. FIG. 1A consists of non-nested alternating outer portions 16*a*–16*d* and inner portions 18*a*–18*d* arranged in a single shingled stream. This configuration is obtained at the output of the deserter 20 at the outfeed conveyor 27 as will be explained below.

Figure 3:
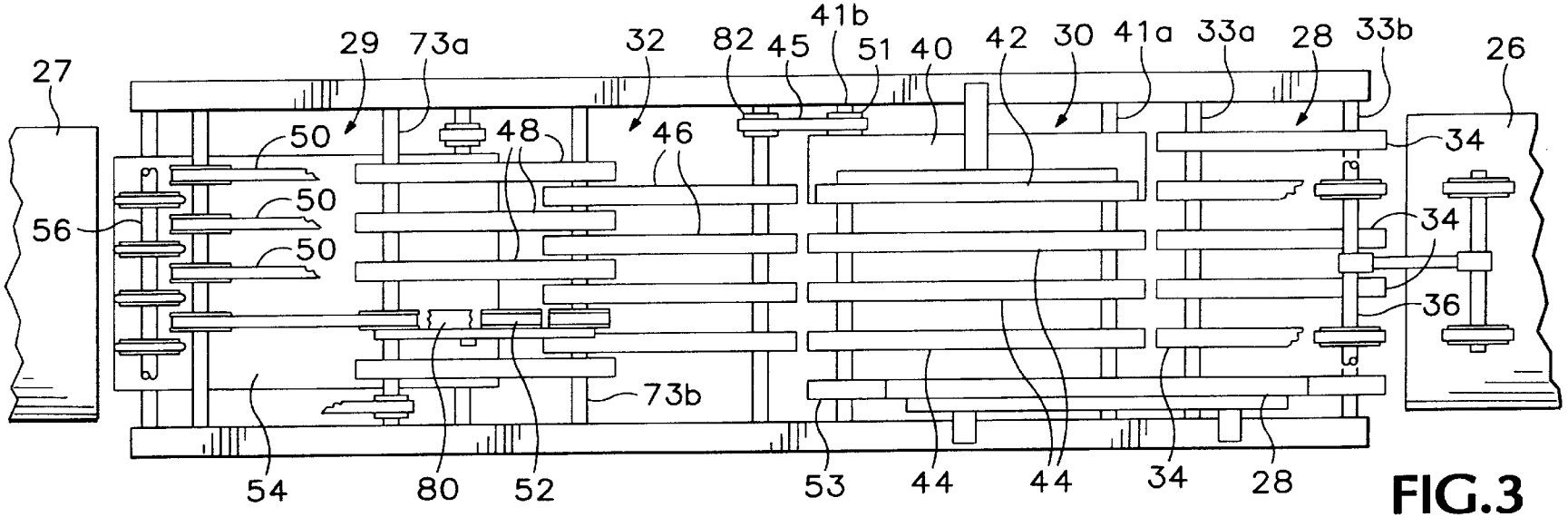
FIG. 3 is a top view of the in-line deserter/integrator of FIG. 2.

As best shown in FIG. 3, the in-line deserter 20 has four primary functional sections. A separator section 28 lengthens the pitch of the shingled stream. A differential speed section 30 partially separates the outer portion 16 of the nested folded product from the inner nested portion 18. A high-speed deshingling section 32 completely separates the folded product. A reintegrator section 29 restacks the separated folded products into a single shingled stream.

The separator section 28 includes a plurality of parallel endless belts 34 which operate at a speed in excess of the base speed of the infeed conveyor belt 26. Additionally, the separator section includes a pressure roller assembly 36 which presses down on the shingled stream, both along the infeed conveyor 26 and along the endless belts 34. The belts 34 are draped about respective pulleys which are in turn rotatably mounted on rods 33*a* and 33*b* which span the frame 22 from side to side. The separator section 28 also includes a pinch roller assembly 38 which engages the edges of the inner nested portions of the books of folded product.

The separator section 28 feeds into the speed differential section 30. This section includes a broad endless belt 40 and a passive pinch roller assembly 42 which rests on top of it. The pinch roller assembly 42 may be adjusted laterally to accommodate books of different width. The belt 40 is looped about pulleys (not shown) which are rotatably mounted on rods 41*a* and 41*b*. A drive sprocket 43 is driven by a toothed belt 45 which in turn drives the belt 40. A second drive sprocket 82 is also engaged by the toothed belt 45. The sprocket 82 drives a set of belts 46 at the same speed as belt 40. The toothed belt 45 is coupled by way of an idler pulley 47 to a motor 49. On the side opposite the belt 45 are a plurality of endless belts 44 together with the pinch roller 38 which sits atop an endless drive belt 53. The belts 44 are looped around pulleys 51 and 61, and the toothed belt 53 drives the pulleys 51 and 61 which are mounted on rods 41*b* and 33*a*, respectively. The toothed belt 53 is driven by a motor 55 and tensioned by an idler pulley 57. As will be explained below, there is a difference in speed between the endless belt 40 and the belts 44, and this speed differential serves to pull apart the books 14 by advancing each outer portion 16 with respect to its inner nested portion 18. The motor speeds are chosen so that the belt 40 runs about 20% faster than belts 44. In addition, the belts 44 run at the same speed as the belts 34 of the separator section 28. The motor 55 drives both sets of belts by way of pulleys 51 and 61. The toothed belt 53 and the conveyor belts 44 are mounted on rods 41*a* and 41*b*, as is the belt 40. The belt 40 can nevertheless be driven at a higher speed than the belts 44 because the pulley (not shown) that it is looped around on rod 41*b* includes a bearing (not shown). Thus, a single set of support rods 41*a* and 41*b* may be used even in view of this speed differential.

The speed differential section 30 feeds into the high-speed deshingling section 32. The deshingling section 32 includes infeed belts 46 which feed into high-speed belts 48. The infeed belts 46 are driven at the same speed as belt 40 by toothed belt 45. An assembly of upper guide belts 50 are coupled to a pinch roller assembly 52 on a frame 80 which sits atop the belts 48. (only a portion of the frame 80 and pinch roller assembly 52 is shown.) The high-speed belts 48 pull the books completely apart and the inner and outer portions which are now separated are engaged one at a time by upper guide belts 50 and fed to the reintegrator section 29.

The reintegrator section 29 reshingles the separated product into a single non-nested shingled stream essentially as shown in FIG. 1A. A single wide endless belt 54 is placed underneath the upper guide belts 50 to receive the shingled stream as each product portion is ejected, one piece at a time, by the high-speed belts 48 and the upper guide belts 50. A set of press rollers 56 press against the top of the wide endless belt 54 whose speed substantially matches that of belts 34. The shingled stream is passed by the endless belt 54 to the outfeed conveyor 27.

A motor 66 drives the belts of the high-speed deshingling section 32 and the reintegrator section 29. The motor 66 is coupled through a speed reduction pulley 68 to a toothed belt 70 which is in turn looped over a toothed pulley 72 to drive belt 54. A second toothed belt 74 is coupled to a toothed pulley 76 to drive the high-speed belts 48 through pulleys 71*a* and 71*b* which are mounted on rods 73*a* and 73*b*. The guide belts 50 are passively driven by the high-speed belts 48. The belts 50 are looped over pulleys 75*a* and 75*b* (other pulleys not shown). These pulleys 75*b* are mounted on the frame 80 and the pulleys 75*a* are mounted on a rod 77*a*.

Figure 4:
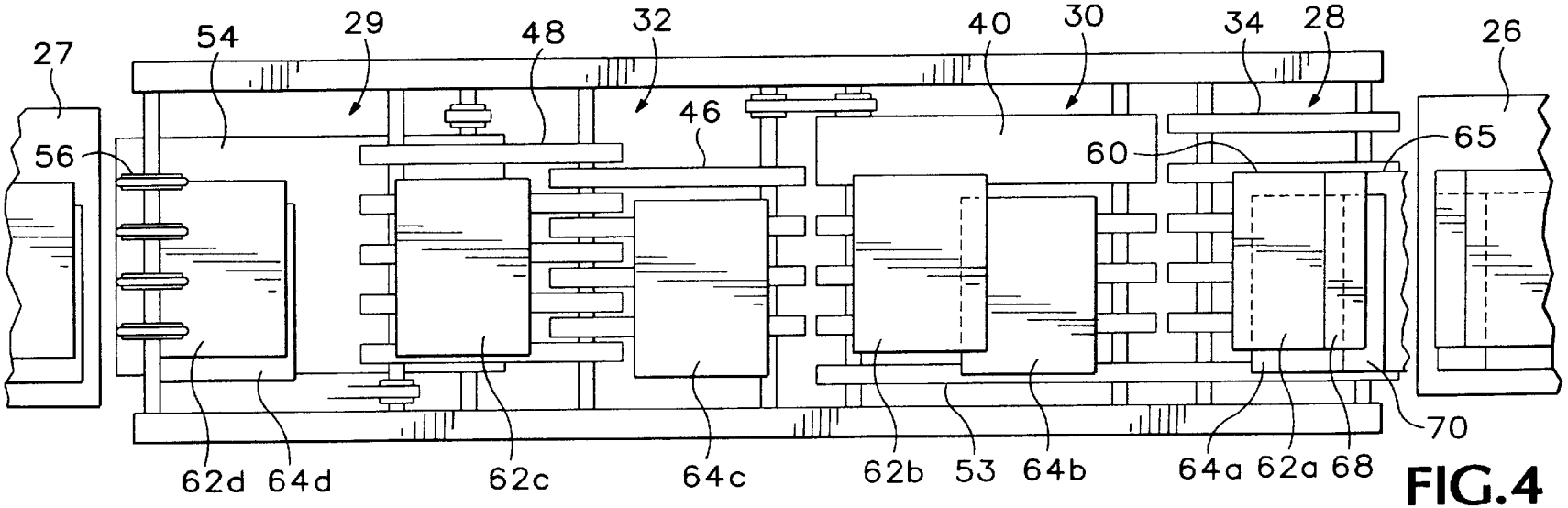
FIG. 4 is a top view of the in-line deserter/integrator of FIG. 3 with the top passive roller portions removed to show the operation of the conveyor on a shingled stream of nested product.

FIG. 4 shows the actual operation of the deserter/integrator 20. (The placement of the books of folded product are for illustration purposes only, because in operation the books would be much closer together.) Books 60 and 66 include outer portions 62 and 68, respectively, and inner nested portions 64 and 70, respectively. At the separator section 28 the pitch of the books has increased but the outer and inner portions are still nested together. For ease of illustration only one book is shown at the differential speed, high-speed deshingling, and reintegrating sections 30, 32 and 29, respectively. When a book reaches the speed differential section 30, the belt 40, running at a higher speed than belts 44 and 53, pulls the outer portion 62*b* ahead of the inner nested portion 64*b*. This pulling apart function is provided by the speed differential between belts 40 and 44, 53 in conjunction with the pinch rollers 42 and 38 which sit atop belts 40 and 53, respectively. The pinch roller 42 grips the outside edge of the outer portion 62*b* and the pinch roller 38 grips the opposite side edge of the inner nested portion 64*b* forcing the two portions apart at different forward speeds.

The leading outer portion 62*c* is accelerated ahead of the inner nested portion 64*c* by the high-speed deshingling section 32. Since the belts 48 run at a speed that is about ten times as fast as the base speed, each partially separated book portion is pulled completely free by the belts 48 in conjunction with pinch roller 52. The books are then fed to the reintegrator section 29 and wide conveyor belt 54 by the upper guide belts 50. As each portion 62*d*, 64*d* is deposited, one on top of the other on conveyor belt 54, a single shingled stream is established which is fed to the outfeed conveyor 27. The stream is tamped laterally by equipment located downstream of conveyor 27 to eliminate the small lateral offset that exists when the book portions are deposited on belt 54.

In another embodiment of the invention the belt 40 and its associated pinch roller 42 may be mounted on a turntable so that it can rotate as a unit relative to the forward direction of the other conveyor belts on the frame 22. A gearing system in the turntable can be used to transfer torque to the belt 40. In addition the turntable could be mounted on rods or tracks which would enable it to be moved either laterally or forwardly so as to provide three different degrees of freedom for the orientation of the belt 40 and its associated pinch roller assembly 42. The frame 22 could then be doubled in width to accommodate an additional infeed conveyor similar to conveyor 26. In this configuration the apparatus is capable of integrating two separate streams of nonnested shingled product. This embodiment is shown in FIG. 5.

Figure 5:
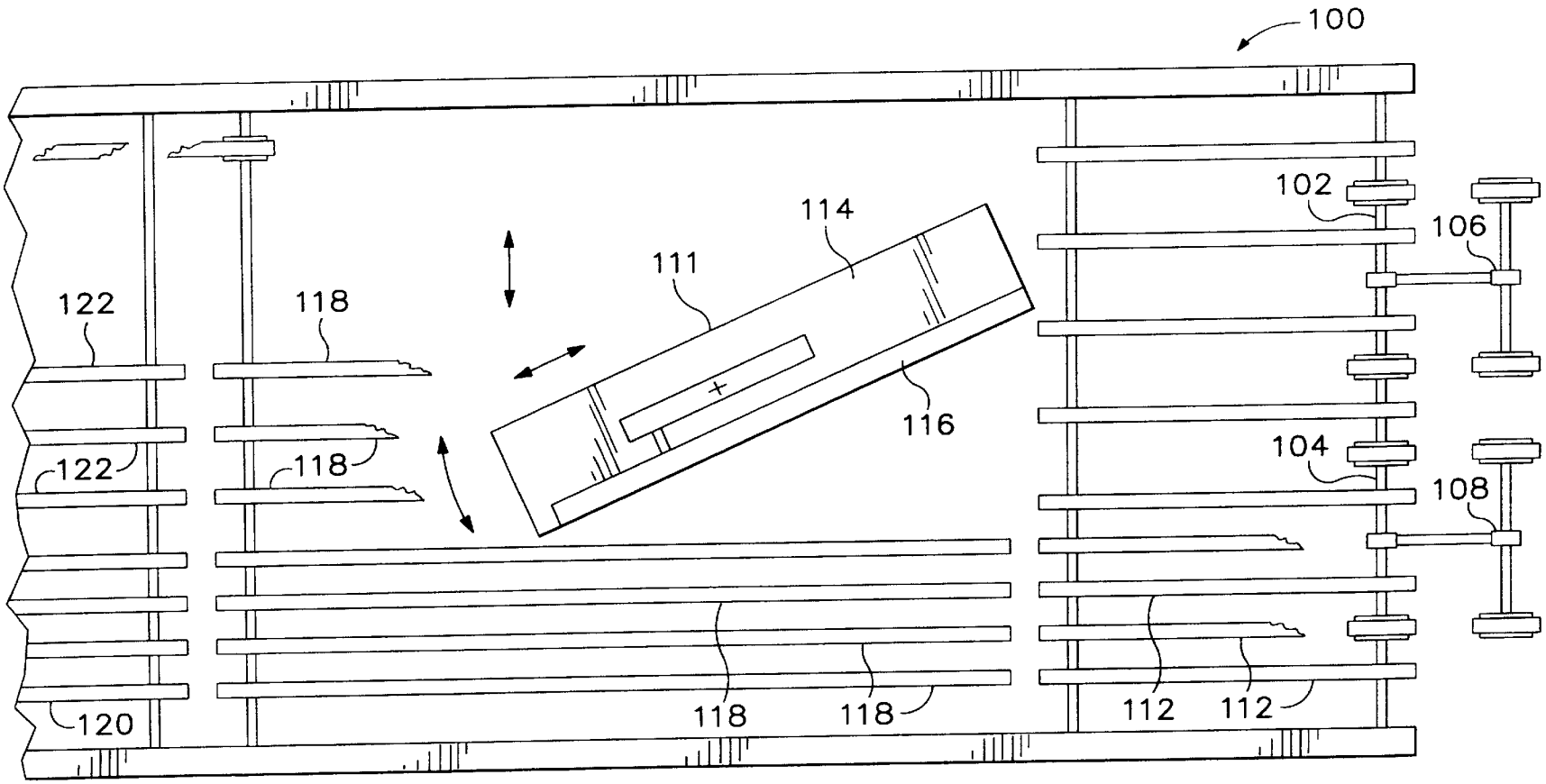
FIG. 5 is a schematic top view of an embodiment of the invention configured as a dual stream integrator apparatus.

Referring to FIG. 5, a dual stream integrator 100 includes input sections 102 and 104, each having associated press rollers 106 and 108. Belts 110 and 112 convey the product from two side-by-side input conveyor belts (not shown). In this embodiment the product is a stream of nonnested shingled books. The product stream from belts 110 are fed to a rotatably mounted conveyor unit 111 comprising an endless belt 114 driven by an internal motor and gearing system and an associated pinch roller assembly 116. As the arrows in FIG. 5 show, the rotatable conveyor apparatus 111 may be rotated, move laterally or move back and forth to provide any desired orientation with respect to all of the other belts whose directional orientations are fixed. The unit 111 may be slidably mounted on tracks or rails (not shown). The product stream handled by belts 112 is fed through a second set of belts 118. Because of the angular orientation of the rotatable conveyor unit 111 which may have a variable speed, the two product streams will merge on belts 118. Because of the differences in speeds, however, the individual books of product can be made to merge out of phase with each other and then be delivered in this way to a high speed belt section 120. The high speed belt section 120 includes belts 122 which pull the staggered merged product one book at a time off of the belts 118 for subsequent processing essentially as described in connection with the embodiment of FIGS. 2–4, the apparatus downstream of section 120 being essentially of the same construction.

If desired, the rotatable unit 111 can be pointed away from belts 112 so that a nested product may be pulled off at an angle in a manner similar to that described in the above-mentioned U.S. patent application Ser. No. 08/334,267.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for deserting and reintegrating books of nested folded product, each of said books having an outer portion and an inner nested portion, said books being transported by an infeed conveyor in a shingled stream at a base speed and having a predetermined pitch, comprising the steps of:

(a) lengthening the pitch of the shingled stream;

(b) moving an outer portion of each of said books ahead of an inner portion while both portions are being conveyed linearly in a forward direction; and (c) reshingling said portions into a single stream of product.

2. The method of claim 1 wherein step (a) is accomplished by conveying the shingled stream from said infeed conveyor to a separator endless belt operating at a speed in excess of the base speed.

3. The method of claim 2 wherein said speed of said separator endless belt is at least twice as fast as the base speed.

4. The method of claim 1 wherein step (b) is accomplished by pinning an edge of said outer portion of each of said books against a first endless belt moving at a first differential speed, and simultaneously pinning an edge of said inner portion against the second endless belt moving at a second differential speed, the first differential speed exceeding the second differential speed so as to pull apart said outer portion ahead of said inner portion.

5. The method of claim 4 wherein the speed of the first endless belt is approximately 20% faster than the speed of the second endless belt.

6. The method of claim 5 wherein the speed of the second endless belt and the speed of the separator endless belt are the same.

7. The method of claim 1 wherein step (b) is further accomplished by accelerating the speed of the outer and inner book portions in sequential fashion by a high-speed deshingling conveyor belt operating at a speed in excess of said base speed.

8. The method of claim 4 wherein said high-speed deshingling conveyor belt operates at a speed approximately ten times as fast as the base speed.

9. An in-line deserter for separating books of nested folded product, each nested folded product comprising an outer portion and an inner portion comprising:

(a) an infeed conveyor transporting said nested folded product in a shingled stream at a base speed, said shingled stream having a predetermined pitch;

(b) a separator conveyor section having a speed that exceeds said base speed for lengthening the pitch of said shingled stream;

(c) a speed differential section having a first endless belt and pinch roller on one side thereof pinching an edge of said outer portion of said book and a second endless belt and pinch roller on an opposite side thereof pinching an edge of said inner portion of said book, the first endless belt and pinch roller having a speed greater than that of the second endless belt and pinch roller thereby pulling said portions apart; and (d) a deshingling section operating at a speed higher than that of either the first or second endless belt of the speed differential section; and (e) a top feeding conveyor belt section for layering said inner and outer nested portions alternately into a single shingled stream.

10. The in-line deserter of claim 9 wherein the first endless belt of the speed differential section has a speed that is approximately 20% faster than that of the second endless belt.

11. The in-line deserter of claim 10 wherein the separator conveyor section has a speed at least twice as fast as the base speed of the infeed conveyor.

12. The in-line deserter of claim 11 wherein the deshingling section operates at a speed that is approximately ten times the base speed of the infeed conveyor.

13. The in-line deserter of claim 9, further including separate drive motors for said separator conveyor section, said second endless belt of said speed differential section and said deshingling section.

14. The in-line deserter of claim 13 wherein the speed of the endless belt of the separator conveyor section and the speed of the first endless belt of the speed differential section are the same.

* * * * *